US008201751B2

(12) United States Patent
Cox et al.

(10) Patent No.: US 8,201,751 B2
(45) Date of Patent: Jun. 19, 2012

(54) RAILWAY RAIL PAD

(75) Inventors: Stephen John Cox, Richmond (GB); Robert John Hamilton, Woking (GB)

(73) Assignee: Pandrol Limited, Addlestone, Surrey (GB)

( * ) Notice: Subject to any disclaimer, the term of this patent is extended or adjusted under 35 U.S.C. 154(b) by 8 days.

(21) Appl. No.: 12/679,829

(22) PCT Filed: Oct. 8, 2008

(86) PCT No.: PCT/GB2008/003395

§ 371 (c)(1), (2), (4) Date: May 3, 2010

(87) PCT Pub. No.: WO2009/047493

PCT Pub. Date: Apr. 16, 2009

(65) Prior Publication Data

US 2010/0206958 A1 Aug. 19, 2010

(30) Foreign Application Priority Data

Oct. 11, 2007 (GB) ..... 0719900.3

(51) Int. Cl.
*E01B 9/38* (2006.01)

(52) U.S. Cl. ..... 238/283; 238/264

(58) Field of Classification Search ..... 238/283, 238/382, 349, 351, 287, 293
See application file for complete search history.

(56) References Cited

U.S. PATENT DOCUMENTS 1,750,735 A * 3/1930 Tupper ..... 238/283
3,358,927 A * 12/1967 Hein et al. ..... 238/338

(Continued)

FOREIGN PATENT DOCUMENTS

| | | |
|---|---|---|
| DE | 2 210 741 | 2/1973 |
| DE | 296 08 777 U1 | 8/1996 |
| FR | 1204262 | 1/1960 |
| GB | 2 435 285 A | 8/2007 |
| JP | 7 238502 | 2/1994 |

OTHER PUBLICATIONS

U.K. Intellectual Property Office's Search Report for priority United Kingdom Application No. GB 0719900.3, date of search Jan. 9, 2008.

(Continued)

*Primary Examiner* — S. Joseph Morano
*Assistant Examiner* — Jason C Smith
(74) *Attorney, Agent, or Firm* — Husch Blackwell LLP

(57) ABSTRACT

In a railway rail pad having a rail seat portion for receiving a foot of a railway rail, the rail seat portion is provided on at least one major face thereof with a plurality of protrusions which are unevenly distributed across the face of the rail seat portion such that the ratio of the area of the face occupied by the protrusions to the area of the face free of protrusions is greater in an edge region of the rail seat portion than in a central region of the rail seat portion, the edge region being adjacent to one edge of the pad and the central region being adjacent to the edge region. The studs are arranged in columns, each stud being of substantially the same size, and the number of studs in a column in the central region which is closest to said edge region being greater than in a column closer to the center of the rail seat portion. The studs are also arranged in rows, wherein the ratio of protrusions to free area in a row of studs adjacent to, but spaced from, the center of the rail seat portion is greater than that in a row further from the center.

6 Claims, 2 Drawing Sheets

U.S. PATENT DOCUMENTS

| | | | | |
|---|---|---|---|---|
| 4,618,093 | A * | 10/1986 | Young et al. | 238/283 |
| 4,635,846 | A * | 1/1987 | Todd | 238/264 |
| 4,971,247 | A * | 11/1990 | Harkus | 238/283 |
| 5,203,502 | A * | 4/1993 | Young | 238/283 |
| 5,549,245 | A * | 8/1996 | Kish | 238/283 |
| 5,692,677 | A * | 12/1997 | Duconseil | 238/283 |
| 5,730,357 | A * | 3/1998 | Besenschek et al. | 238/283 |
| 6,045,052 | A * | 4/2000 | Besenschek | 238/382 |
| 6,305,613 | B1 * | 10/2001 | Igwemezie | 238/287 |
| 6,422,479 | B1 * | 7/2002 | Adkins et al. | 238/288 |
| 6,471,139 | B1 * | 10/2002 | Bruder et al. | 238/283 |
| 6,648,238 | B2 * | 11/2003 | Larke | 238/264 |
| 7,080,791 | B2 * | 7/2006 | Geissele et al. | 238/264 |
| 7,100,837 | B2 * | 9/2006 | Young | 238/382 |
| 7,261,244 | B2 * | 8/2007 | Urmson et al. | 238/287 |
| 7,374,109 | B2 * | 5/2008 | Ellerhorst | 238/283 |
| 7,648,080 | B2 * | 1/2010 | Hohne et al. | 238/351 |
| 7,717,352 | B2 * | 5/2010 | Loffelsend et al. | 238/382 |
| 2004/0113133 | A1 * | 6/2004 | Geissele et al. | 254/43 |
| 2004/0155117 | A1 * | 8/2004 | Urmson et al. | 238/287 |
| 2006/0118649 | A1 * | 6/2006 | Urmson et al. | 238/287 |
| 2009/0108086 | A1 * | 4/2009 | Mospan et al. | 238/287 |
| 2009/0261177 | A1 * | 10/2009 | Hamilton et al. | 238/283 |
| 2010/0206958 | A1 * | 8/2010 | Cox et al. | 238/283 |

OTHER PUBLICATIONS

International Search Report for International Application No. PCT/GB2008/003395, mailed Jan. 29, 2009.

English translation of abstract of JP 7 238502.

Data supplied by the espacenet's database indicating that English translation of abstract of DE2210741 (B1) is not available.

Data supplied by the espacenet's database indicating that English translation of abstract of DE29608777 (U1) is not available.

Data supplied by the espacenet's database indicating that English translation of abstract of FR 1204262 (A) is not available.

* cited by examiner

RAILWAY RAIL PAD

The present invention relates to a railway rail pad.

Railway rail pads are provided between a foot of a railway rail and an underlying rail foundation, the pad having a rail seat portion for receiving the rail foot. Rail pads are typically made of resilient elastomeric material such as ethylene vinyl acetate (EVA). In a typical rail pad the rail seat portion is provided with a plurality of protrusions, such as studs or ribs, on one or both major faces. The design of the pad and the material used to make it are chosen so as to ensure that the pad has desired stiffness and wear characteristics, according to the requirements of the railway track in which it is to be used.

According to the present invention there is provided a railway rail pad for location between a foot of a railway rail and an underlying rail foundation, the pad having a rail seat portion for receiving a foot of a railway rail, two opposite edges of which rail seat portion extend parallel to the longitudinal axis of the rail when the pad is in use, which rail seat portion is provided with a plurality of studs on at least one major face thereof, wherein the studs are unevenly distributed across the said face of the rail seat portion such that the ratio of the area of said face occupied by said studs to the area of said face free of said studs is greater in an edge region of the rail seat portion than in a central region of the rail seat portion, said edge region being adjacent to one of said edges and said central region being adjacent to said edge region; wherein the studs are arranged in columns, extending substantially parallel to said opposite edges, each stud being of substantially the same size, and the number of studs in a column in the central region which is closest to said edge region being greater than in a column closer to the centre of the rail seat portion, and wherein the studs are also arranged in rows, extending substantially transverse to said opposite edges, wherein the ratio of protrusions to free area in a row of studs adjacent to, but spaced from, the centre of the rail seat portion is greater than that in a row further from the centre.

Such a pad may have reduced stiffness as compared to a conventional pad, in which the ratio is constant over substantially all of the rail seat region, whilst restricting rail roll and pad wear to an acceptable level, particularly in the edge region of the pad which is that part of the pad subject to the greatest loading and therefore most susceptible to wear.

Preferably the ratio is also greater in another edge region of the rail seat portion, adjacent to the other of the edges, than in the said central region.

In a preferred embodiment, the area of each of the studs is the same and the spacing between the studs varies.

The studs are preferably distributed symmetrically with respect to a first centre line of the rail seat portion extending parallel to the said longitudinal rail axis. Desirably, the studs are also distributed symmetrically with respect to a second centre line of the rail seat portion extending perpendicular to the said longitudinal rail axis.

Reference will now be made, by way of example, to the accompanying drawings, in which.

Figure 1B:
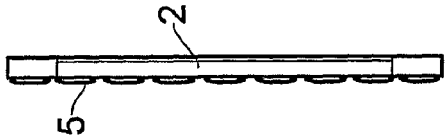
FIG. 1B shows a side view of the pad of FIG. 1A.
Figure 1D:
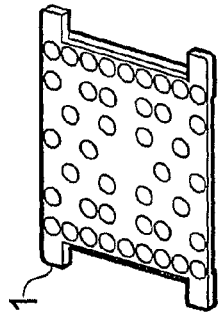
FIG. 1D shows a perspective view of the pad of FIG. 1A.

As shown in FIGS. 1A to 1D a pad 1 embodying the present invention has an approximately rectangular rail seat portion 2 and four ear portions 3*a*, 3*b*, 3*c*, 3*d* formed respectively at the four corners of the rail seat portion 2. The ears 3*a*, 3*b*, 3*c*, 3*d* serve to locate the pad 1 on a rail foundation (not shown) with respect to clip anchoring shoulders (not shown). When the pad is in use beneath a rail, a first edge 2*a* of the rail seat portion 2 between the ears 3*a* and 3*b* and a second edge 2*b* of the rail seat portion between the ears 3*c* and 3*d* lie transverse to the longitudinal axis of the rail and a third edge 2*c* of the rail seat portion 2 between the ears 3*a* and 3*c* and a fourth edge 2*d* of the rail seat portion between the ears 3*b* and 3*d* lie substantially parallel to the longitudinal axis of the rail (not shown).

The rail seat portion 2 has two major faces 4A, 4B on each of which are formed a plurality of studs 5 of substantially circular cross-section and equal size. The studs 5 are distributed unevenly across each major face, in register with studs 5 on the other major face, such that the ratio of the area occupied by the studs 5 on the face of the rail seat portion 2 to the area of that face free of studs 5 is greater in edge regions 6*a*, 6*b* of the rail seat portion 2 than in a central region 7 of the rail seat portion 2, the edge regions 6*a*, 6*b* being adjacent respectively to the third and fourth edges 2*c*, 2*d* of the rail seat portion 2 and the central region 7 being adjacent to the edge regions 6*a*, 6*b*. The ratio decreases gradually across the rail seat region 2 from the edges 2*c*, 2*d* to the centre 2*e* of the rail seat region 2. In this way, the stiffness of the pad is reduced whilst restricting rail roll and pad wear to an acceptable level.

In this embodiment the desired ratio, and hence pad characteristics, is obtained by selecting the number and location of the studs 5 in the edge and central regions 6*a*, 6*b*, 7.

Figure 1A:
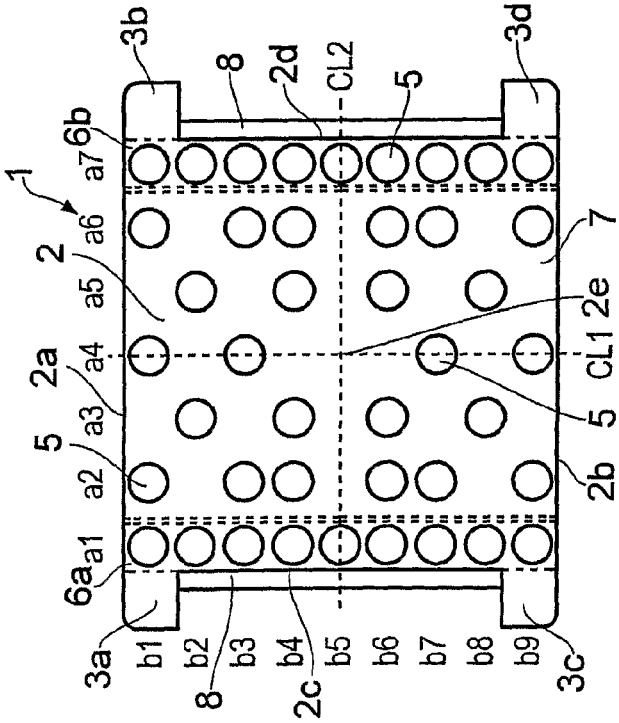
FIG. 1A shows a plan view of a pad embodying the present invention.
Figure 1C:
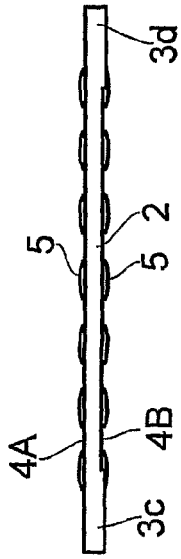
FIG. 1C shows an end view of the pad of FIG. 1A.

In particular, in the pad 1, the studs 5 are arranged in columns parallel to the edges 2*c*, 2*d* of the rail seat portion 2. There are 7 columns a1 to a7 parallel to the edges 2*c*, 2*d*. As shown in FIG. 1A there are 9 studs in columns a1 and a7, 6 studs in columns a2 and a6, 4 studs in columns a3 and a5 and 4 studs in column a4. Thus, the number of studs in a column in the central region 7 which is closest to the edge region 6*a*, 6*b* is greater than in a column closer to the centre 2*e* of the rail portion 2*a*.

The studs in columns a1 to a7 are also arranged in rows parallel to the edges 2*a*, 2*b*. There are 9 rows b1 to b9. As shown in FIG. 1A there are 5 studs in rows b1 and b9, 4 studs in rows b2 and b8, 5 studs in rows b3 and b7, 6 studs in rows b4 and b6, and 2 studs in row b5. Thus, in this embodiment, the ratio of protrusions to free area in a row of studs adjacent to, but spaced from, the centre 2*e* of the rail seat portion 2 is greater than that in a row further from the centre.

In total the pad 1 has 42 studs on each face 4A and 4B of the pad 1.

The pattern of studs 5 is such that they are arranged symmetrically with respect to the two centre lines CL1, CL2 of the rail seat portion 2. Column a4 lies on the centre line CL1 and row b5 lies on the centre line CL2.

In this way, the pad can be used correctly either way round on the rail foundation provided that the ears 3*a* to 3*d* are located on the clip anchoring shoulders. The pad 1 has a retention lip 8 between ears 3*a* and 3*c* along edge 2*c* and another retention lip 8 between ears 3*b* and 3*d* along edge 2*d*, to hold the pad down and make it captive in a rail fastening assembly. If these lips 8 were not required and were omitted, since the pattern of studs 5 on each major face 4A, 4B of the rail seat portion is the same, the pad could also be used either way up.

Figure 2:
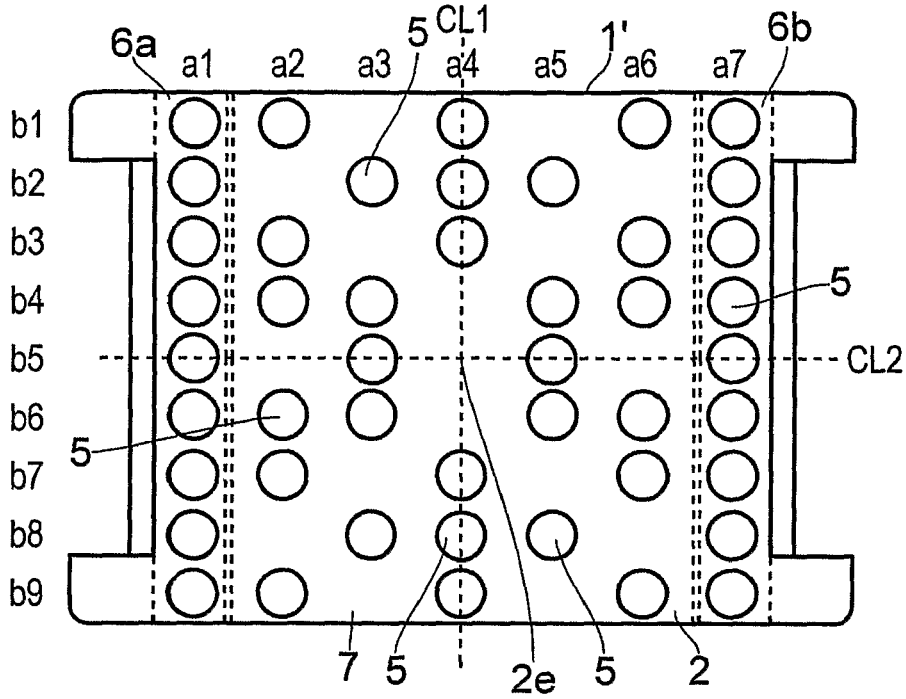
FIG. 2 shows a plan view of a first alternative pad embodying the present invention.

Another embodiment of the pad has additional studs 5 placed, for example, in column a4, at rows b2 and b8, and in columns a3 and a5, at row b5, to adjust the stiffness of the pad as required. Such a pad 1' is shown in FIG. 2. This pad has a total of 46 studs.

Table 1 below shows the respective ratios of protrusions to free area for pads A, B, C and D of different sizes and having different numbers of studs.

Figure 3:
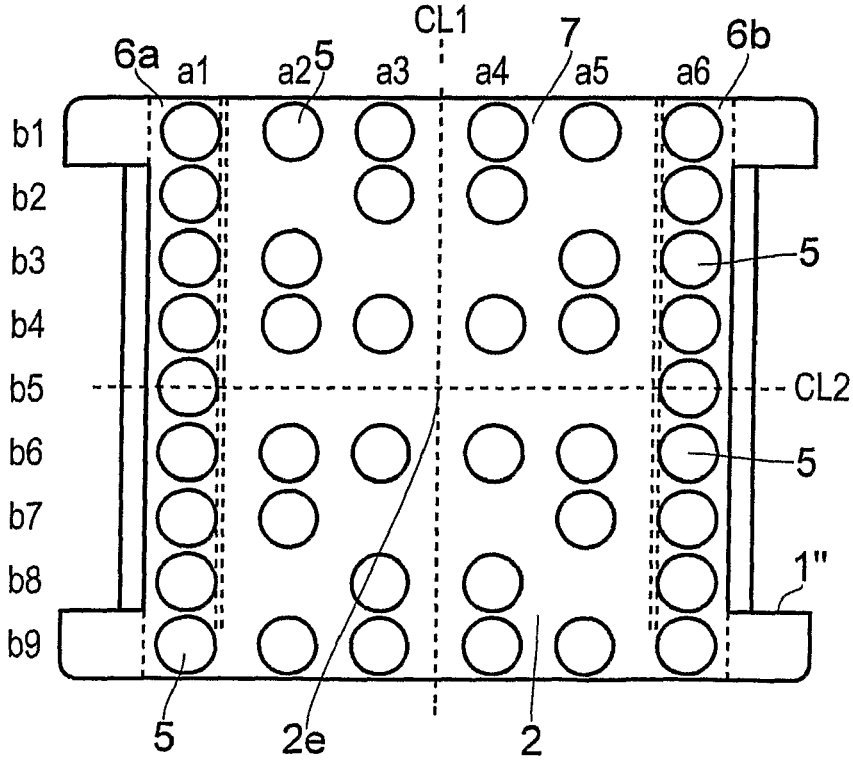
FIG. 3 shows a plan view of a second alternative pad embodying the present invention.

The pad 1 shown in FIG. 1 is a pad of type A and the pad 1' shown in FIG. 2 is a pad of type B. FIG. 3 shows a pad 1" of type C.

In one embodiment of pad 1, having a rail seat portion 2 of thickness 5.3 mm in a part between studs 5 and of thickness 9 mm in a part having studs 5, the pad was made of EVA material of a grade having approximately 9% VA content. The dynamic stiffness of the pad was 193.8 kN/mm. Under a standard 3 million cycle inclined wear test the pad stiffened 16.8%. In comparison a softer pad, made of EVA material of a grade having approximately 14% VA content, and having 62 studs of the same size, had a dynamic stiffness of 196 kN/mm but stiffened in the wear test to a much larger degree, 27.8%.

TABLE 1

| | Pad A | Pad B | Pad C | Pad D |
|---|---|---|---|---|
| Pad Size | 145 × 150 mm | | 145 × 125 mm | |
| No. of Studs/ Diameter | 42/10 mm | 46/10 mm | 42/10 mm | 46/10 mm |
| Width of Edge Region | 21.45 mm | 21.45 mm | 17.84 mm | 17.84 mm |
| Area of Edge Region | 3144.31 $mm^2$ | 3144.31 $mm^2$ | 2586.8 $mm^2$ | 2586.8 $mm^2$ |
| Area of Studs in Edge Region | 706.86 $mm^2$ | 706.86 $mm^2$ | 706.86 $mm^2$ | 706.86 $mm^2$ |
| Area of Edge Region free of Studs | 2437.45 $mm^2$ | 2437.45 $mm^2$ | 1879.94 $mm^2$ | 1879.94 $mm^2$ |
| Ratio of Stud Area to Free Area in Edge Region | 0.29 | 0.29 | 0.38 | 0.38 |
| Width of Central Region | 107.07 mm | 107.07 mm | 89.34 mm | 89.34 mm |
| Area of Central Region | 15527.12 $mm^2$ | 15527.12 $mm^2$ | 12954.3 $mm^2$ | 12954.3 $mm^2$ |
| Area of Studs in Central Region | 1884.96 $mm^2$ | 2199.12 $mm^2$ | 1884.96 $mm^2$ | 2199.12 $mm^2$ |
| Area of Central Region Free of Studs | 13642.16 $mm^2$ | 13328 $mm^2$ | 11069.34 $mm^2$ | 10755.18 $mm^2$ |
| Ratio of Stud Area to Free Area in Central Region | 0.14 | 0.165 | 0.17 | 0.20 |

What is claimed is:

1. A railway rail pad for location between a foot of a railway rail and an underlying rail foundation, the pad comprising:

a rail seat portion for receiving a foot of a railway rail, the rail seat portion having two opposite edges which extend parallel to a longitudinal axis of the rail when the pad is in use, the rail seat portion is provided with a plurality of studs on at least one major face thereof, wherein at least some of the studs are located along the centre line parallel to the longitudinal axis of the rail or wherein substantially no studs are located in the inner region of the centre line which lies perpendicular to the longitudinal axis of the rail, wherein the studs are unevenly distributed across the face of the rail seat portion such that the ratio of the area of the face occupied by the studs to the area of the face free of the studs is greater in an edge region of the rail seat portion than in a central region of the rail seat portion with the edge region being adjacent to one of the edges wherein the central region is adjacent to the edge region wherein the studs are arranged in columns, extending substantially parallel to the opposite edges, each stud being of substantially the same size, and the number of studs in a column in the central region which is closest to the edge region being greater than in a column closer to the center of the rail seat portion, and wherein the studs are also arranged in rows extending substantially transverse to the opposite edges, wherein the ratio of protrusions to free area in a row of studs adjacent to, but spaced from, the center of the rail seat portion is greater than that in a row further from the center.

2. A pad as in claim 1, wherein the ratio is also greater in another edge region of the rail seat portion, adjacent to the other of said edges, than in the central region.

3. A pad as in claim 1, wherein the area of each of the studs is the same and the spacing between the studs varies.

4. A pad as in claim 1, wherein the studs are distributed symmetrically with respect to a first center line of the rail seat portion extending parallel to the longitudinal rail axis.

5. A pad as in claim 4, wherein the studs are distributed symmetrically with respect to a second center line of the rail seat portion extending perpendicular to the longitudinal rail axis.

6. A railway rail pad for location between a foot of a railway rail and an underlying rail foundation, the pad comprising:

a rail seat portion for receiving a foot of a railway rail, the rail seat portion having two opposite edges which extend parallel to a longitudinal axis of the rail when the pad is in use, the rail seat portion including a plurality of studs on at least one major face thereof wherein at least some of the studs are located along the centre line parallel to the longitudinal axis of the rail or wherein substantially no studs are located in the inner region of the centre line which lies perpendicular to the longitudinal axis of the rail wherein the studs are unevenly distributed across the face of the rail seat portion such that the ratio of the area of the face occupied by the studs to the area of the face free of the studs is greater in an edge region of the rail seat portion than in a central region of the rail seat portion.

* * * * *